United States Patent [19]

Albus

[11] Patent Number: 4,883,184

[45] Date of Patent: Nov. 28, 1989

[54] CABLE ARRANGEMENT AND LIFTING PLATFORM FOR STABILIZED LOAD LIFTING

[76] Inventor: James S. Albus, 952 W. Stanhope Rd., Kensington, Md. 20891

[21] Appl. No.: 205,091

[22] Filed: Jun. 10, 1988

Related U.S. Application Data

[62] Division of Ser. No. 866,252, May 23, 1986, abandoned.

[51] Int. Cl.[4] ..... B66C 13/06; B66C 13/16; B66C 23/72; B66C 11/00

[52] U.S. Cl. ..... 212/146; 212/147; 212/148; 212/153; 212/156; 212/159; 212/195; 212/205; 212/225; 212/228; 212/257; 212/142.1

[58] Field of Search ..... 212/146–148, 212/195–198, 205, 210, 211, 214, 216, 217, 225, 227, 232, 255, 257, 142.1

[56] References Cited

U.S. PATENT DOCUMENTS

| | | |
|---|---|---|
| 2,916,162 | 12/1959 | Gercke . |
| 3,043,444 | 7/1962 | Melton . |
| 3,081,884 | 3/1963 | Minty . |
| 3,191,983 | 6/1965 | Gaglione . |
| 3,272,347 | 9/1966 | Lemelson . |
| 3,598,440 | 8/1971 | Ramsden et al. . |
| 3,675,960 | 7/1972 | Mangold . |
| 3,743,107 | 7/1973 | Verschoof . |
| 3,826,380 | 7/1974 | Lenander et al. . |
| 3,863,970 | 2/1975 | Gottlieb et al. . |
| 4,350,254 | 9/1982 | Noly . |
| 4,376,487 | 3/1983 | Van Soest et al. . |
| 4,437,114 | 3/1984 | LaRussa . |
| 4,441,125 | 4/1984 | Parkinson . |
| 4,666,362 | 5/1987 | Landsberger et al. . |

FOREIGN PATENT DOCUMENTS

| | | |
|---|---|---|
| 961894 | 1/1975 | Canada . |
| 2316810 | 10/1977 | Fed. Rep. of Germany . |
| 0033244 | 3/1977 | Japan . |
| 144032 | 8/1977 | Japan . |
| 89385 | 6/1937 | Sweden ..... 294/67.2 |
| 895902 | 1/1982 | U.S.S.R. . |
| 1186738 | 4/1970 | United Kingdom . |
| 2053590 | 5/1972 | United Kingdom ..... 212/147 |

OTHER PUBLICATIONS

Stewart, "A Platform with Six Degrees of Freedom", The Institution of Mechanical Engineers, vol. 180, Part I, No. 15, pp. 371–386, Proceeding 1965–1966.

Landsberger et al., "A New Design for Parallel Link Manipulators", pp. 812–814, Proceedings I.E.E.E. Conference, November 1985.

*Primary Examiner*—Joseph F. Peters, Jr.
*Assistant Examiner*—R. B. Johnson
*Attorney, Agent, or Firm*—Banner, Birch, McKie & Beckett

[57] ABSTRACT

The present invention is directed to a cable arrangement and lifting platform for lifting a load in a stabilized manner. The lifting platform secures loads to a securing device and the platform is able to be suspended from a crane by an attachment carriage. The attachment carriage includes a cable winch onto which six cables suspend and attach to the lifting platform. The attachment carriage also includes cable guides which guide the six cables away from the winch in three cable pairs, preferably equidistantly-spaced. In order to secure the cables to the lifting platform, the platform includes an attachment frame having three cable attachment points, preferably spaced equidistantly apart with respect to each other. The lifting platform helps stabilize the lifting of loads by sensing the load's imbalance relative to the center of mass of the platform and repositioning the load to correct for the imbalance. In addition, in order to precisely position the load and exert controlled forces on the load in all six degrees of freedom, the present invention includes a device for rotating the load 360° angle relative to the horizontal plane, a device for adjusting the tilt position of the load up to a 90° angle relative to the horizontal plane of the platform, and a device for rotating the load in 360° angle about the longitudinal axis of the load securing device.

8 Claims, 6 Drawing Sheets

CABLE ARRANGEMENT AND LIFTING PLATFORM FOR STABILIZED LOAD LIFTING

This application is a division of application Ser. No. 866,252, filed May 23, 1986 now abandoned in favor of continuation application Ser. No. 220,888, filed June 16, 1988, and still pending.

BACKGROUND OF THE INVENTION

1. Technical Field

The present invention relates to load handling devices for stabilizing the lifting of a load. More particularly, the present invention relates to a cable arrangement and a lifting platform, such as a six-axis range of motion robot having self-balancing means, for the stabilized lifting of a load attached thereto.

2. Background Information

Lifting platforms are well known in the art. Commonly, lifting platforms are attached to cranes, such as overhead tower cranes having a horizontal boom and boom cranes having a diagonal boom. Applications for these lifting platforms include transporting cargo on and off ships, and relocating necessary equipment and materials on a construction site. In order to best understand the present invention, a cartesian coordinate system will be defined such that the Z-axis is in the vertical direction, and the X and Y axes form the horizontal plane. Roll is defined as rotation about the Z-axis; pitch is rotation about the X-axis; and yaw is rotation about the Y-axis.

In typical load transporting applications, a crane will have a single lifting cable. In these applications, the lifting cable is stable only in the Z direction. Under any pressure from the sides, the load will either rotate in roll, pitch and yaw, or will sway in the X and Y directions.

The prior art has long recognized the need to stabilize the load suspended from a single load lifting cable. For example, in U.S. Pat. No. 2,916,162 issued to Gercke, a diagonal boom crane is shown having a single load lifting cable for transporting loads. Gercke is directed to an apparatus for damping the pendulum motions of the load suspended from the lifting cable. The Gercke apparatus comprises a plurality of L-shaped levers which surround the load lifting cable near the top of the boom crane. As the load lifting cable sways, these levers are caused to move, and their movement is sensed by sliding potentiometers. Each lever is attached to a potentiometer, and all potentiometers are attached to a motor which controls the position of the levers. The more the load tends to swing, the more the levers try to suppress the load's swing. Although Gercke may tend to suppress the pendulum motions in the X and Y directions, the Gercke device fails to suppress any load imbalance causing roll, pitch or yaw. Such drawbacks are inherent with single-cable lifting devices.

Other systems have been developed which try to solve the problems inherent in single-cable load lifting arrangements by employing a plurality of cables. For example, in U.S. Pat. No. 3,743,107 issued to Verschoof, a four cable arrangement system is shown for preventing a container load, attached to a container yoke with the yoke suspended from four hoisting cables, from swinging in the horizontal direction. Four cables are used in the Verschoof system: two cables are attached to a common winch and wrap around the container yoke via pulleys, the ends of these two cables being securely attached to the frame which secures the winch; the other two cables are attached to the container yoke in a cross-hatched manner such that the cables are securely attached to the container yoke at one end, and attached to the securing frame via tension devices. The tension devices sense cable slack, due to load imbalance and shifting, and adjust the tension on the respective cables such that the tension on both cables remain equal. Verschoof allows for the hoisting and lowering of the container yoke via the first two cables, while providing for load imbalance in the horizontal plane via the second pair of cables.

Both Gercke and Verschoof are directed to stabilizing loads by sensing any load imbalance through the attachment cables. Other systems, however, are directed to sensing load imbalance at the load attachment platform. For example, U.S. Pat. No. 4,350,254 issued to Noly, herein incorporated by reference, is directed to a load platform suspended from an overhead tower crane by four lifting cables. The lifting platform, a spreader frame for attaching to railroad containers and the like, includes means for adjusting the load along the length of the platform based on imbalance in that direction. Additionally, the lifting platform includes means for rotating the attached load in a 360° angle of rotation and means for tilting the attached load in a slight angle relative to the lifting platform for ease of lifting and/or placement of the load. The four lifting cables which attach the lifting platform to the overhead tower crane are adjusted via a pair of winches, each winch attaching to the opposite pair of cables. Although Noly allows for automatic load imbalance compensation in the direction relative to the length of the lifting platform by moving the load in that direction, Noly does not compensate for load imbalance in the direction relative to the width of the lifting platform by movement of the load. Rather, Noly states that any imbalance along the width of the load platform is compensated by the dual-winch take-up system having the opposite cables attached thereto. Although Noly's use of a dual-winch take-up system compensates for load imbalance in the direction of width, a dual-winch system adds considerable complexity and cost to load handling systems. Additionally, should a load imbalance be substantial in the direction of width, the strain and tension on the cables will lead to a serious degradation in the integrity of the cables and the winch system.

SUMMARY OF THE INVENTION

Accordingly, it is an object of the present invention to provide a simplified load handling apparatus having a load attachment platform which adjusts for load imbalance in both the X and Y directions of the load lifting platform.

Additionally, it is an object of the present invention to provide a load handling apparatus having a load attachment platform which can precisely position the load and exert controlled forces on the load in all six degrees of freedom.

Further, it is an object of the present invention to provide a load handling apparatus having the load attachment platform suspended from multiple suspension cables in an arrangement which provides superior resistance to platform sway and roll, yet requires only a single take-up winch.

It is also an object of the present invention to provide a load handling apparatus which is easily adaptable to conventional cranes.

The present invention is directed to a cable arrangement and lifting platform for lifting a load in a stabilized manner. The lifting platform secures loads to a securing means, and the platform is able to be suspended from a crane, either an overhead tower crane or a boom crane having a diagonal boom, by means of an attachment carriage. The attachment carriage includes a cable winch onto which six cables suspend and attach to the lifting platform. The attachment carriage also includes cable guides which guide the six cables away from the winch in three cable pairs, preferably equidistantly-spaced. In order to secure the cables from the attachment carriage to the lifting platform, the platform includes an attachment frame having three cable attachment points, preferably spaced equidistantly apart with respect to each other. The lifting platform helps stabilize the lifting of loads by a load balancing means, which senses the difference in location of the center of gravity of the load relative to the center of the triangle formed by the three cable attachment points, and positioning means, which automatically positions the center of gravity of the load substantially under the center of the triangle. In addition, in order to precisely position the load and exert controlled forces on the load in all six degrees of freedom, the present invention includes means for rotating the load in a 360° angle relative to the horizontal plane, means for adjusting the tilt position of the load up to a 90° angle relative to the horizontal plane of the platform, and means for rotating the load in a 360° angle about the longitudinal axis of the load securing means. When the load platform is attached to a crane, precise positioning of and controlled forces on the load are available in all six degrees of freedom anywhere within the working volume of the crane.

DESCRIPTION OF THE PREFERRED EMBODIMENTS

Figure 1:
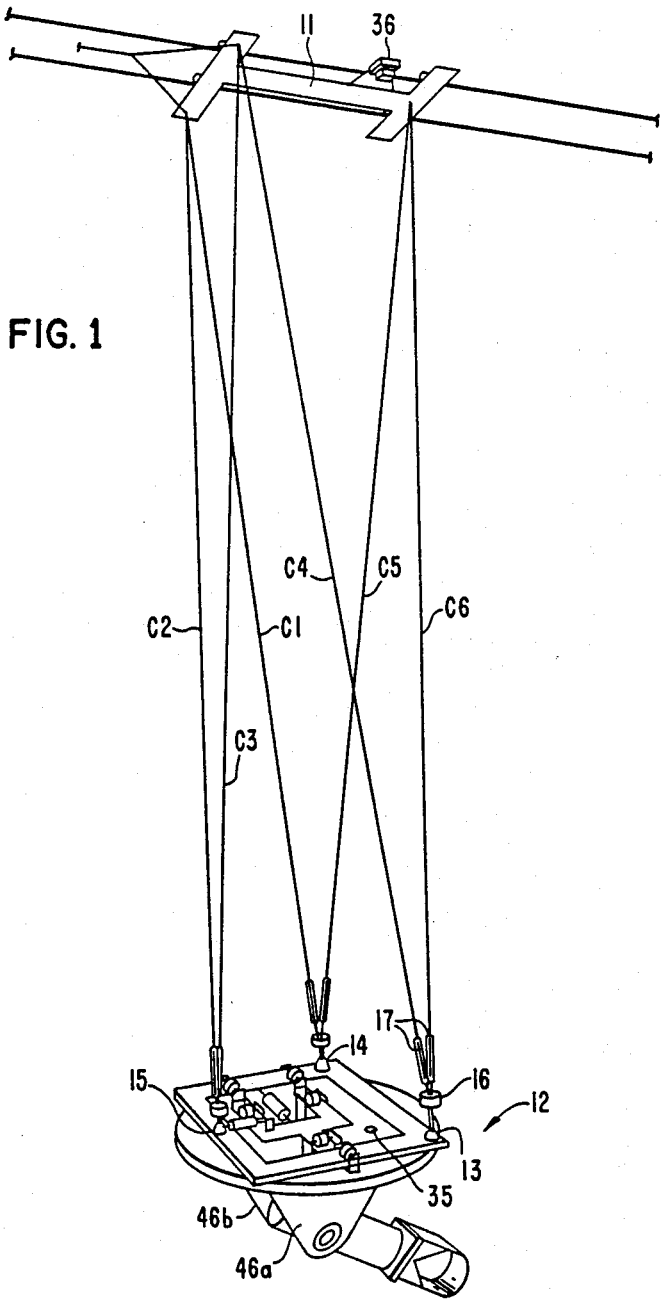
FIG. 1 shows an overall view of the stabilized load lifting device of the present invention.

Turning now to FIG. 1, an overall view of the stabilized load lifting device of the present invention is shown. The load lifting device includes cable suspension carriage 11, load platform 12 (discussed in more detail below with reference to FIGS. 3 and 4), and suspension cables C1 through C6. Cables C4 and C6 attach to the load platform at first attachment point 13. Likewise, cables C1 and C5 and cables C2 and C3 attach to the load platform at second cable attachment point 14 and third cable attachment point 15, respectively. In the preferred embodiment, the third cable attachment point is located along the perpendicular bisector of the first and second points. More particularly, all cable attachment points are substantially equidistant with respect to each other. This is preferred because the equidistant arrangement stabilizes the load platform in all six degrees of freedom.

The tendency of the load platform having the equidistant attachment point arrangement to resist displacement in the X- and Y-dimensions and roll is determined by the tangents of the angles that the suspension cables make with the Z-axis. For a practical case where the distance of the load platform from the suspension carriage is less than 10 times the spacing between the cable attachment points, the forces resisting displacement are greater than 10 percent of the weight of the platform plus the load, which is an enormous improvement in stability over a single lifting cable arrangement. Such stability enables the load to be precisely positioned in high winds, and provides a stable platform which can be used to exert torques and side forces on objects being positioned.

In applications where a heavy load is attached to the load platform, the system may have a tendency to overshoot or oscillate under dynamic excitation. The tendency of the system to oscillate and/or overshoot can be reduced, however. In the preferred embodiment, hydraulic spring-shock absorbers 16 are attached at each of the cable attachment points. Additionally, a pair of swivel turnbuckles 17 are preferably attached between the respective cables and the spring-shock absorbers at each of the attachment points. Suspension cables C1 through C6 are wire-rope construction having either a right-hand or left-hand lay. Due to the uneven stretching which occurs with these cables, the turnbuckles allow for independent cable adjustment; due to the cables' internal torsional moment inherent with wire-rope cables, the swivel portion of the turnbuckle allows the cables to turn freely in place, thereby relieving any tension which may be induced in the cables due to use.

Figure 2:
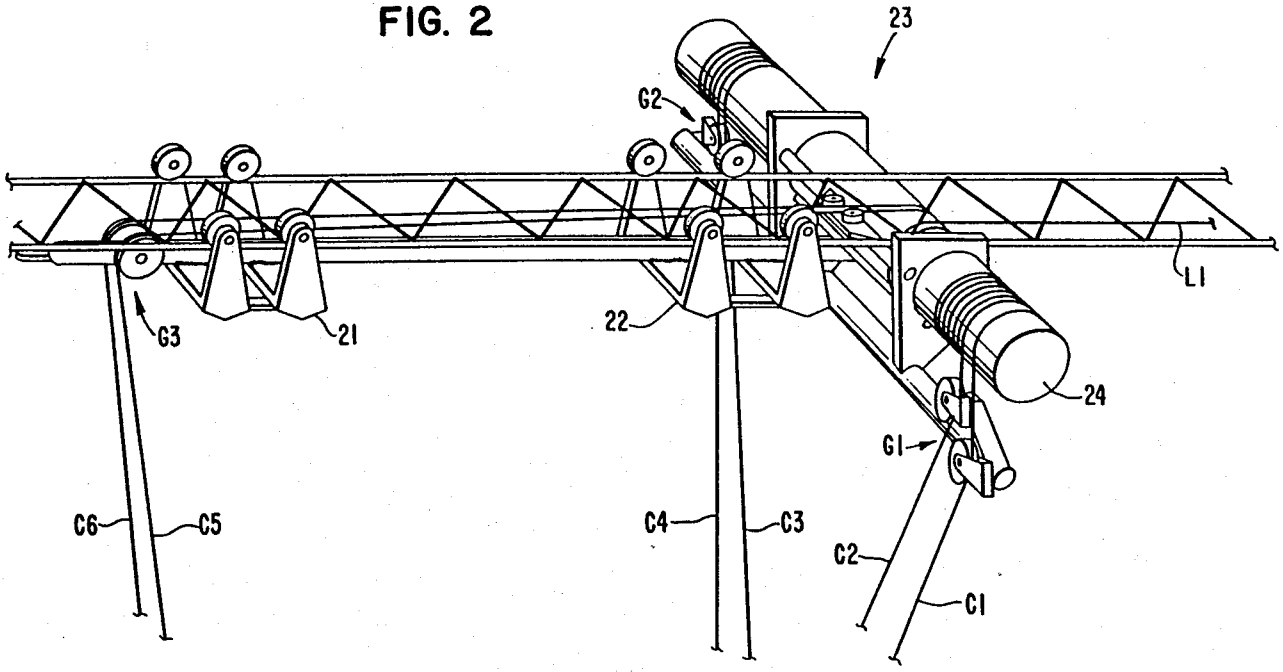
FIG. 2 shows a detailed view of the cable suspension carriage mounted on the track of the boom of a conventional tower crane.

Turning to FIG. 2, a detailed view of the cable suspension carriage mounted on the track of the boom of a conventional tower crane is shown. The cable suspension carriage includes carriage attachment pulleys 21 and 22 for attaching the suspension carriage to the track of the boom of a conventional tower crane. Additionally, winch 23 inludes shaft 24, which is rotatable by the crane's lifting cable L1. The lifting cable is typical on conventional tower cranes, and is used to power the winch on the the cable suspension carriage such that when the crane's lifting cable is pulled by the crane, the winch rotates so as to wind up suspension cables C1 through C6, thereby lifting the load platform. Conversely, when the crane's lifting cable is lengthened, the winch rotates due to the load on the suspension cables so as to unwind the suspension cables and lower the load platform, also winding up the crane's lifting cable on the shaft of the winch. In the preferred embodiment, the winch is designed with a threaded bearing so that the shaft of the winch moves linearly along its axis as it rotates. Furthermore, the pitch of the thread is preferably at least twice the diameter of the suspension cables, allowing all of the cables to wind on the winch shaft in a single layer.

The cable suspension carriage also includes cable guides G1, G2 and G3, for guiding cable pairs C1–C2, C3–C4 and C5–C6, respectively, downward from the shaft and to the load platform. Cable guide G3 also guides cables C5 and C6 horizontally away from the shaft of the winch so that the cable guides more closely align with the positioning of the cable attachment points found on the load platform. In the preferred embodiment, cable guide G3 is along the perpendicular bisector of guides G1 and G2. More particularly, the three cable guides are substantially equidistant with respect to each other. Other cable guide arrangements will be obvious to those skilled in the art. For example, cable guides G1 and G2 could extend to one side of shaft 24, with cable guide G3 extending to the other side of shaft 24. Additionally, all cable guides could direct the suspension cables downward, with the cable attachment points directing the proper course of the individual cables. The preferred embodiment is desired, however, for both its simplicity and its functional relationship with the cable attachment points found on the load platform.

Figure 3:
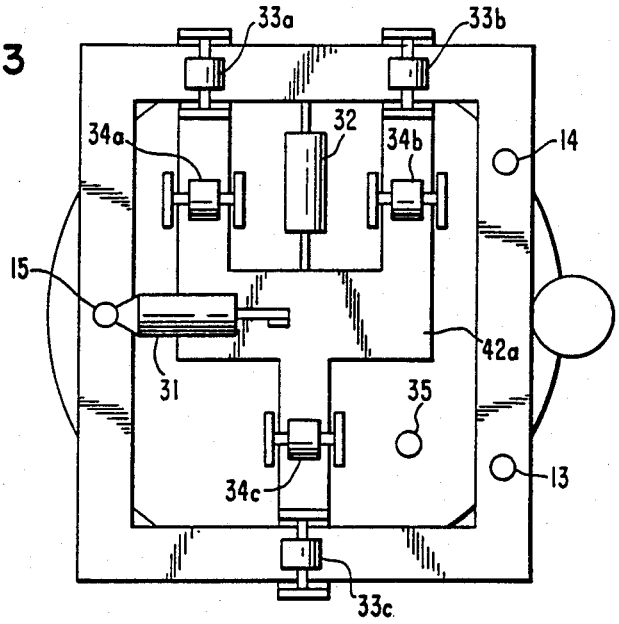
FIG. 3 is a top view of an embodiment of the load platform of the present invention.
Figure 4:
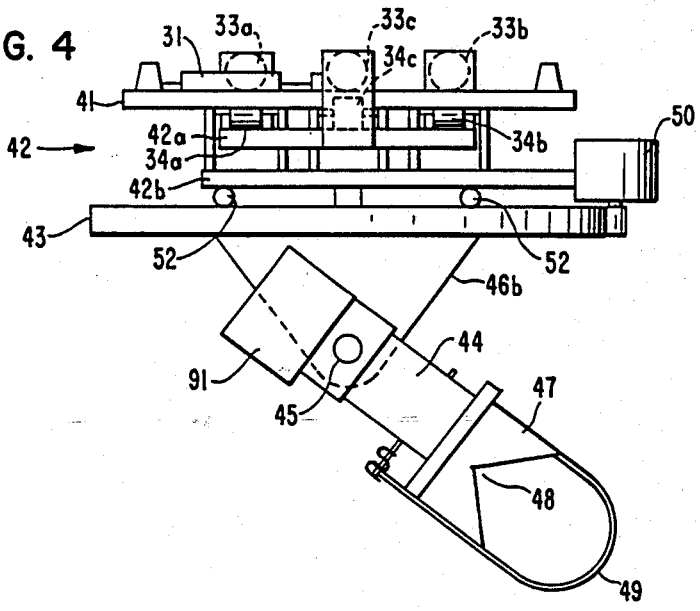
FIG. 4 is a side view of the load platform shown in FIG. 3.

Turning now to FIGS. 3 and 4, one embodiment of the load platform of the present invention is shown in the top and side view, respectively.

As shown in FIG. 4, the load platform includes attachment frame 41, load positioner 42, and circular platform 43. Attached to circular platform 43 is arm 44 pivotally connected at point 45, for clarity with facing pivotal connecting means 46*a* (from FIG. 1) not shown and opposing pivotal connecting means 46*b* shown in hidden view. In the preferred embodiment, load positioner 42 includes Y-member 42*a* and table 42*b*. As shown in FIG. 3, X-axis actuator 31 is attached to attachment frame 41 and Y-member 42*a*. Y-axis actuator 32 is attached to table 42*b* and Y-member 42*a*. The X-axis and Y-axis actuators control the position of rotating platform 43 and, consequently, the position of the load. Wheel suspension system 33*a*, 33*b* and 33*c* allows Y-member 42*a* to freely move along the attachment frame in the X direction. Similarly, wheel suspension system 34*a*, 34*b* and 34*c* allows table 42*b* to move along Y-member 42*a* in the Y direction. The purpose of load positioner 42 is to adjust the load's center of gravity with the center of the triangle formed by attachment points 13, 14 and 15. Various types of load imbalance sensers are known in the art. For example, load imbalance can be sensed by placing tension sensors at the cable attachment points, or making the tension sensors integral with either the turnbuckles, spring-shock absorbers or the cables. In the preferred embodiment, load imbalance is sensed by LED 35 and image sensor 36 (FIG. 1), such as a CCD TV camera. Initialization of the load imbalance senser requires centering the LED in the field of view of the TV camera while the load platform is experiencing no side forces. Thereafter, displacement of the position of the LED from the center of field view in the camera will signal a side force. This displacement is used as a control signal to the X-axis and Y-axis actutors; control circuitry for this operation will be readily obvious to one skilled in the art.

Returning to FIG. 4, arm 44 includes load attacher 47 for attaching loads thereto. Although attacher 47 can be of various shapes depending on the required application, attacher 47 is shown in FIG. 4 as having right-angle cutout 48 for securely positioning a beam, or other corner-containing loads, on two sides thereof and securing the load on the other sides with attachment strap 49. In order to control the roll, pitch and yaw angles of the load, roll actuator 50, pitch actuator (not shown), and wrist-roll actuator 91, respectively, are included on the load platform. Roll actuator 50 is preferably attached to table 42*b* and rotates the circular platform by turning a spur gear (not shown) attached to the platform. Vertical thrust bearings 52 allow the circular platform to freely rotate. The pitch actuator (not shown) is operatively coupled between the arm and the rotating platform for adjusting the arm from about 0° to about 90°. Wrist-roll actuator 91 allows load attachment means 47 to rotate 360° in either direction about its longitudinal axis. Consequently, the addition of the roll actuator, pitch actuator and wrist-roll actuator allows for the precise positioning of a load and the exertion of controlled forces on the load in all six degrees of freedom. When the load platform is attached to a crane, the precise positioning of and controlled forces on the load are available in all six degrees of freedom anywhere within the working volume of the crane.

Figure 5:
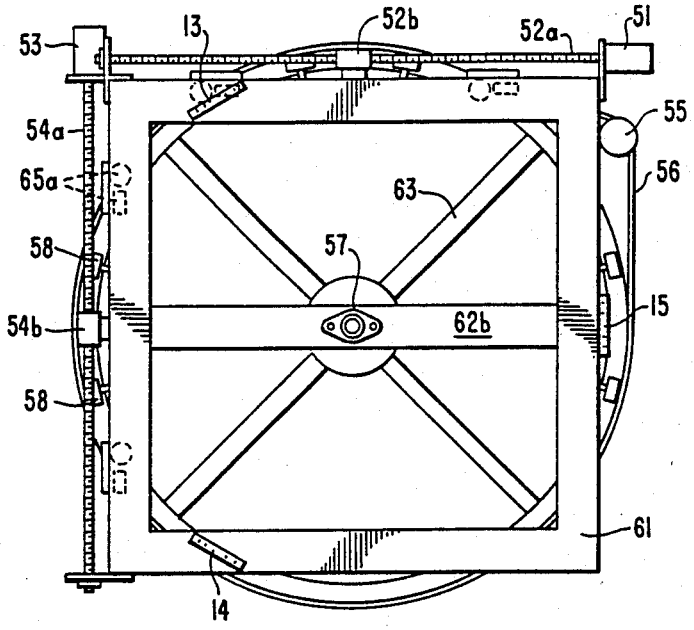
FIG. 5 is a top view of another embodiment of the load platform of the present invention.
Figure 6:
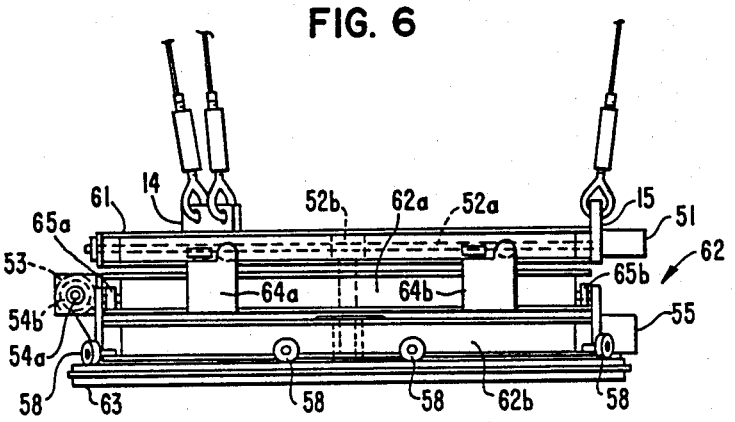
FIG. 6 is a side view of a portion of the load platform shown in FIG. 5.

Turning now to FIGS. 5 and 6, another embodiment of the load platform arrangement is shown in the top and side views, respectively. The embodiment shown in FIGS. 5 and 6 is substantially similar to that embodiment shown in FIGS. 3 and 4, except for the load positioning arrangement, which will now be discussed.

As shown in FIG. 6, the load platform includes attachment frame 61, load positioner 62, and circular platform 63. Attached to circular platform 63 is the arm (not shown), as described with reference to FIGS. 3 and 4, above. In the preferred embodiment, load positioner 62 includes X-frame 62*a* and Y-frame 62*b*. X-frame 62*a* and Y-frame 62*b* are square frames which lie directly beneath attachment frame 61. As shown in FIG. 5, movement along the X-axis is provided by X-axis motor 51 and X-axis ball screw 52*a* through X-axis ball nut 52*b*, and is attached to attachment frame 61 and X-frame 62*a*. Similarly, movement along the Y-axis is provided by Y-axis motor 53 and Y-axis ball screw 54*a* through Y-axis ball nut 54*b*, and is attached to Y-frame 62*b* and X-frame 62*a*. Wheel suspension system 64*a* and 64*b* (FIG. 6) allows X-frame 62*a* to freely move along the attachment frame in the X direction. Similarly, wheel suspension system 65*a* and 65*b* allows Y-frame 62*b* to move along X-frame 62*a* in the Y-direction.

Returning to FIG. 5, roll is provided by roll motor 55, preferably attached to Y-frame 62*b*, rotating circular platform 63 by drive-chain 56 attached to the platform. Vertical thrust bearing 57 allows the circular platform to rotate freely. Rollers 58 are also provided to aid circular platform rotation.

Figure 7:
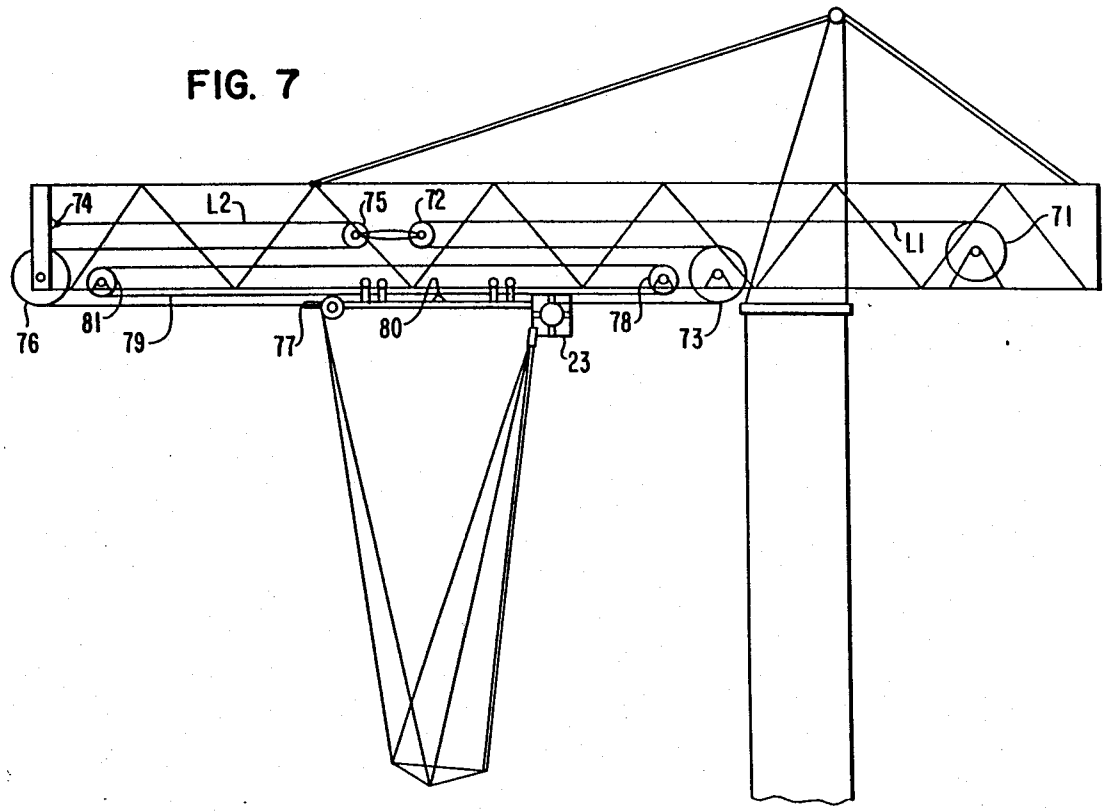
FIG. 7 shows a cable routing scheme for attaching the stabilized load lifting device of the present invention to a conventional tower crane.
Figure 8:
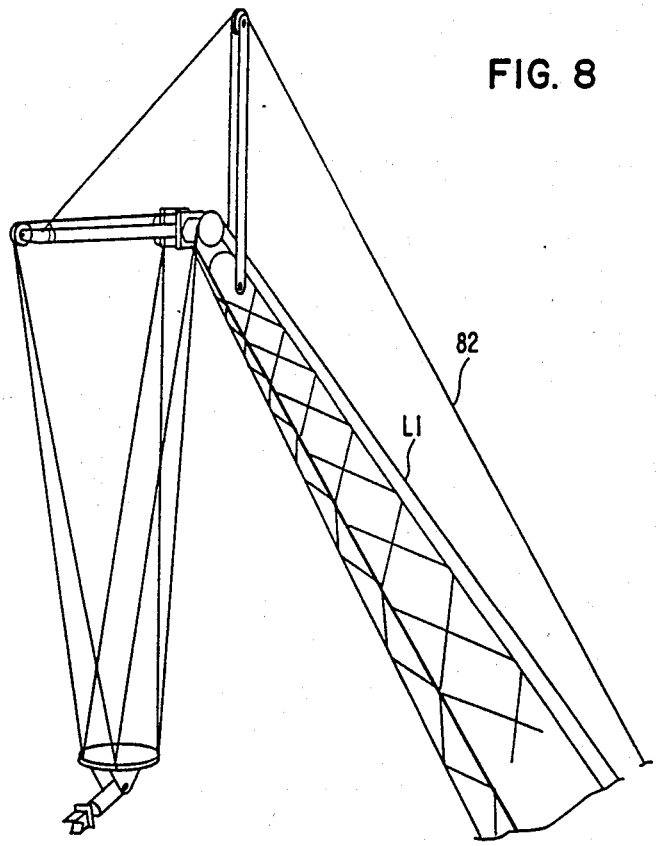
FIG. 8 shows a cable routing scheme for attaching the stabilized load lifting device of the present invention to a diagonal boom crane.

Turning now to FIGS. 7 and 8, a cable routing scheme for attaching the stabilized load lifting device to a conventional tower crane and to a diagonal boom crane, respectively, is shown.

As shown in FIG. 7, a cable routing scheme for attaching the stabilized load lifting device to a conventional tower crane is shown. The load lifting device is mounted on the track of the boom in place of the carriage which normally supports the lifting hook of a conventional tower crane. As discussed above with reference to FIG. 2, lifting cable L1 is used to power winch 23 such that when the crane's lifting cable L1 is shortened, the winch rotates so as to wind up the six suspension cables and thereby lift the stabilized platform. Conversely, when the crane's lifting cable is lengthened, the winch rotates so as to unwind the cables and lower the stabilized platform.

Typically, tower cranes have a cable routing scheme such that the lifting cable exerts no net force on the carriage along the boom. This feature is maintained with the cable routing scheme as shown in FIG. 7. The crane's lifting cable L1 is routed from power winch 71 to carriage winch 23 over a set of pulleys 72 and 73, respectively. Second cable L2 is attached to the end of the boom at attachment point 74, and is routed over pulleys 75 and 76, respectively, and attached to the front of the cable suspension carriage at attachment point 77. The tension in cable L2 is equal and opposite to the tension in cable L1 because of the forces transmitted through pulleys 72 and 75. The result is that tension, or changes in tension, in lifting cable L1 creates no net force on the cable suspension carriage parallel to the boom track. The carriage is nevertheless free to move horizontally along the boom. The horizontal position along the boom can be controlled by winch 78 and cable 79, attached to the cable suspension carriage at attachment point 80 via pulley 81. Thus, the control of the horizontal position is independent of the control of the vertical position of the load platform.

Turning now to FIG. 8, a cable routing scheme for attaching the stabilized load lifting device to a diagonal boom crane is shown. The load lifting device is attached to the end of the diagonal boom; the crane's lifting cable L1 is used to operate the winch, as explained above. The device most preferably should be maintained at a level position in order for the six suspension cables to remain in tension, and the level position can be accomplished, for example, by means of either a cross-bar linkage (not shown) or separate platform leveling cable 82.

The lifting platform could be modified to provide a level platform for transporting bulk loads, such as cargo on or off a ship, or material such as concrete on a construction site, or for suspending an excavation robot for excavation of toxic waste dumps. Additionally, the lifting platform could be used as an elevator stabilizer. Other modifications and applications will be apparent to those skilled in the art. Therefore, although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

I claim:

1. A stabilized load lifting device for use with a crane for lifting and translocating loads, said stabilized load lifting device comprising:

a load platform to secure loads to be lifted, said platform including an attachment frame having first, second and third cable attachment points located such that said third point is along the perpendicular bisector of said first and second points, and load securing means, operatively coupled to said attachment frame, for securing the load to be lifted;

an attachment carriage to operatively couple said load platform to the crane, said carriage including a cable winch having a shaft and means for rotating said shaft, and first, second and third cable pair guides capable of operatively guiding a first and second cable pair downward from said shaft and capable of operatively guiding a third cable pair horizontally away and downward from said shaft;

a first cable pair slidably attached to said first cable pair guide, said first cable pair having first and second cables, one end of said first and second cables coiled about said shaft near one end of said shaft, the other end of said first and second cables operatively coupled to said second and third attachment points, respectively;

a second cable pair slidably attached to said second cable pair guide, said second cable pair having third and fourth cables, one end of said third and fourth cables coiled about said shaft near the other end of said shaft, the other end of said third and fourth cables operatively coupled to said third and first attachment points, respectively; and a third cable pair slidably attached to said third cable pair guide, said third cable pair having fifth and sixth cables, one end of said fifth and sixth cables coiled about said shaft near the center of said shaft, the other end of said fifth and sixth cables operatively coupled to said second and first attachment points, respectively.

2. The stabilized load lifting device of claim 1 wherein said third cable pair guide is along the perpendicular bisector of said first and second cable pair guides.

3. The stabilized load lifting device of claim 2 wherein said first, second and third cable pair guides are substantially equidistant with respect to each other.

4. The stabilized load lifting device of claim 1 further comprising damping means, operatively coupled between each of said cable attachment points and the respective cables, for suppressing oscillations and overshoot due to an attached load's movement.

5. The stabilized load lifting device of claim 1 wherein said first, second and third cable attachment points are substantially equidistant with respect to each other.

6. The stabilized load lifting device of claim 1 wherein said means for rotating said shaft comprises a crane lifting cable wound around said shaft to raise and lower said load platform.

7. The stabilized load lifting device of claim 6 wherein the crane comprises a boom along which said crane lifting cable extends to move said attachment carriage horizontally along the boom, said crane lifting cable being supported by a first pulley mechanism, a tension equalizing cable attached at one end to the free end of the boom, said tension equalizing cable extending around a second pulley mechanism and attached at its other end to an end of said attachment carriage opposite said shaft, said first and said second pulley mechanisms being connected so that tension in said tension equalizing cable is equal and opposite to tension in said crane lifting cable whereby tension in said crane lifting cable creates no net force on said attachment carriage parallel to the boom.

8. The stabilized load lifting device of claim 6 further comprising a positioning cable attached to said attachment carriage, said positioning cable controlling the horizontal positioning of said carriage independently of the raising and lowering of said attachment frame by said crane lifting cable.

* * * * *